US005235997A

United States Patent [19]

Good

[11] Patent Number: 5,235,997

[45] Date of Patent: Aug. 17, 1993

[54] COMPACT COLLAPSIBLE UMBRELLA

[75] Inventor: Sidney R. Good, Cleveland, Ohio

[73] Assignee: Good Marketing, Inc., Cleveland, Ohio

[21] Appl. No.: 759,539

[22] Filed: Sep. 13, 1991

[51] Int. Cl.[5] ..... A45B 25/18

[52] U.S. Cl. ..... 135/25.3; 135/33.4

[58] Field of Search ..... 135/33.2, 33.4, 33.41, 135/19.5, 25.3

[56] References Cited

U.S. PATENT DOCUMENTS

| | | | |
|---|---|---|---|
| 1,781,479 | 11/1930 | Schwartz | 135/34.2 |
| 1,827,335 | 10/1931 | Rochefort | 135/19.5 |
| 3,177,883 | 4/1965 | Militano | 135/19.5 |
| 3,446,221 | 5/1969 | Truitt | 135/19.5 |
| 4,182,352 | 1/1980 | Hermanson | 135/19.5 |
| 4,542,758 | 9/1985 | Okuda | 135/25.3 |
| 4,821,756 | 4/1989 | England | 135/19.5 |

FOREIGN PATENT DOCUMENTS

| | | | |
|---|---|---|---|
| 776092 | 1/1935 | France | 135/19.5 |
| 686850 | 2/1953 | United Kingdom | 135/19.5 |

*Primary Examiner*—Henry E. Raduazo

*Attorney, Agent, or Firm*—Pearne, Gordon, McCoy & Granger

[57] ABSTRACT

An inexpensive collapsible umbrella which is made entirely from plastic and which has an integral cover or case formed from cylindrical segments affixed to the canopy frame with the canopy partially sandwiched therebetween has been disclosed. The canopy support frame is formed from a plurality of articulated canopy support arms, each having three ribs and a strut connected to one another through living hinges so that the arms can be folded with the ribs at least partially overlapping one another. The umbrella can be folded into a compact cylindrical shape for convenient storage and handling.

18 Claims, 4 Drawing Sheets

Fig. 1
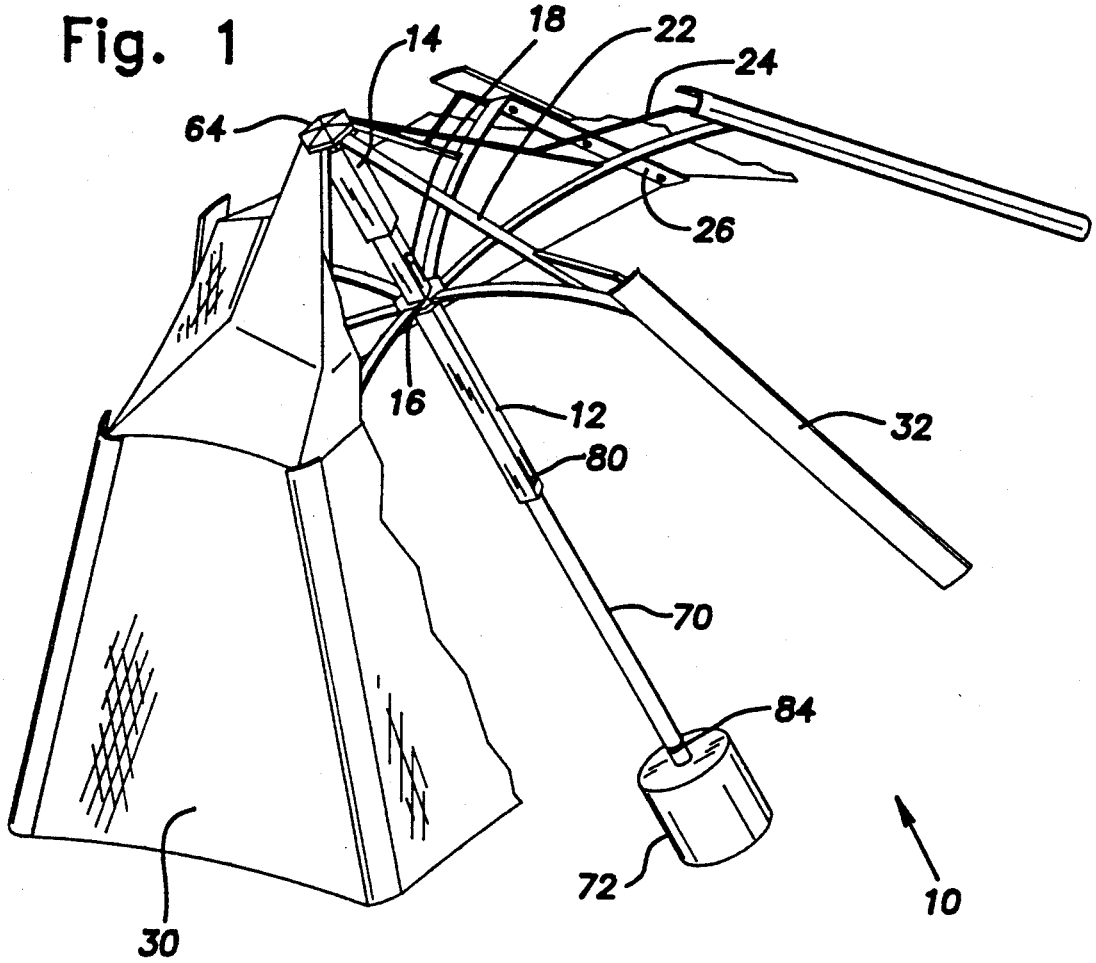
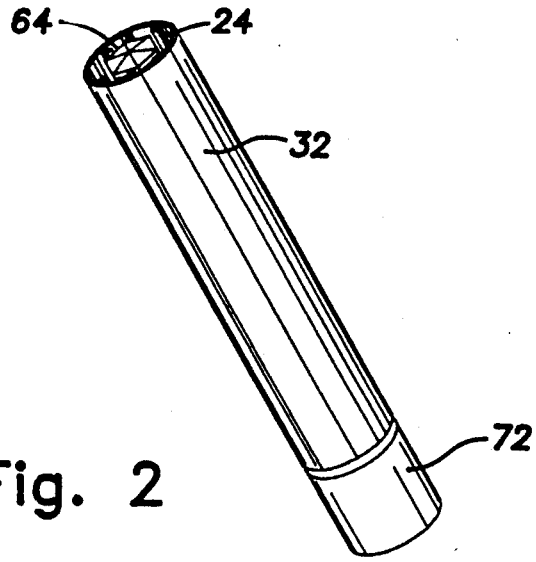
Fig. 2

COMPACT COLLAPSIBLE UMBRELLA

BACKGROUND OF THE INVENTION

1. Field of the Invention

The invention is generally directed toward a collapsible umbrella, and more particularly toward an inexpensive, thermoplastic umbrella, having an integral cover or case, which when folded into the nested position forms a compact cylindrical shape.

2. Description of Related Art

The desirability of an inexpensive collapsible umbrella for limited use, on such occasions when protection from unexpected inclement weather is needed but the expense of a conventional umbrella is regarded as unjustified, has long been recognized.

U.S. Pat. No. 2,621,669 to Mayer shows a disposal umbrella made by cutting slits into two cardboard or plastic sheets to form the canopy support ribs and struts respectively, stapling the sheets together, and then curling the sheets to form the canopy support structure.

U.S. Pat. No. 3,177,883 to Militano shows a similar arrangement wherein the ribs and struts are formed together in a single plastic molding, and U.S. Pat. No. 3,564,679 to Meyer shows an improvement wherein the entire canopy support structure and the shaft of the umbrella are formed in a single injection molding.

A collapsible disposable umbrella made from thermoplastic, having an inner shaft and a canopy support structure disposed in a cylindrical hollow tube which acts as a protective case in the nested position and as a handle in the deployed position is shown in U.S. Pat. No. 4,821,756 to England.

In addition to being made from inexpensive materials such as plastic and being easily assembled, it is also desirable that a disposable umbrella be capable of being folded into a compact, durable, stackable configuration for storage, and be capable of being easily deployed when needed.

Thus, while various collapsible disposable umbrellas are known, they generally do not fold into a compact nested configuration but, to the contrary, fold into a configuration having a length which is at least equal to the length of a canopy support rib. In addition, most known disposable umbrellas do not fold into a nested configuration having a uniform diameter along the length of the umbrella shaft and are not, therefore, ideally suited for stacking. Moreover, when they are stacked or stored, they are susceptible to damage because the fabric is exposed. The England patent, which discloses a disposable umbrella disposed in a cylindrical tube, is well suited for stacking, but is not easily deployed. Deployment of the umbrella shown in the England patent requires first pulling the shaft and attached canopy support assembly from the tube, then sliding a lower hub member up along the shaft until it abuts an upper hub member, and finally reinserting the shaft, with the canopy extended, back into the tube.

According, the present invention provides an inexpensive plastic umbrella which, when folded or collapsed into a nested condition, assumes a compact, durable cylindrical shape having a cylinder length which is substantially shorter than the length of a radially extending rib assembly when the umbrella is in its deployed condition.

SUMMARY OF THE INVENTION

The present invention is an inexpensive, collapsible umbrella which when folded into its collapsed, undeployed or nested condition takes a compact shape, having a length which is substantially less than the combined length of the ribs comprising a single arm or spoke of the rib support structure, as measured from the axis of the umbrella shaft to the edge of the canopy when the umbrella is in its deployed condition.

The umbrella shaft has a hub secured to its upper end. A slider is slidably received on the shaft for movement along the shaft. The canopy support structure includes a plurality of articulated canopy support arms which extend radially from the axis of the shaft. Each arm is hingedly connected to the hub and to the slider. The arrangement of the various ribs strut relative to one another in the support arms provides an articulated support structure in a plastic umbrella which causes the various rib members or segments to at least partially overlap one another when the umbrella is folded into its nested condition, thereby providing a more compact configuration for storage than would otherwise be possible.

In accordance to another aspect of the invention, the canopy is secured to the radially extending support arms by a rib cover affixed to each outer rib with a portion of the canopy connected therebetween. When the umbrella is folded into its nested configuration, the longitudinal edges of each rib cover at least partially abut an edge of an adjacent rib cover thereby forming a substantially continuous shape. In the nested configuration, the canopy and canopy support arms are contained in a region between the shaft and the cylinder formed by the rib covers. The compact shape of the nested umbrella permits efficient stacking of the umbrella in a relatively small space, which is advantageous for shipping and storing of the umbrella.

The umbrella, including the canopy, is preferably made entirely from plastic materials such as polyolefins, with polypropylene/olyethylene copolymers being most preferred.

The umbrella shaft is preferably hollow to slidably receive a telescoping rod which can be extended to increase the effective length of the shaft when the umbrella is being used. In the nested configuration, the rod can be slid back into the shaft so that the handle abuts the bottom of the cylinder formed by the rib covers, thereby retaining a perfect cylindrical or other shape in the nested configuration.

BRIEF DESCRIPTION OF THE DRAWINGS

FIG. 1 is a perspective view of a nearly fully deployed umbrella embodying the invention with portions of the canopy broken away to expose the canopy support structure in the deployed configuration;

FIG. 2 is a perspective view of the umbrella shown in FIG. 1 with the umbrella folded to its nested configuration;

DESCRIPTION OF THE PREFERRED EMBODIMENT

Figure 3:
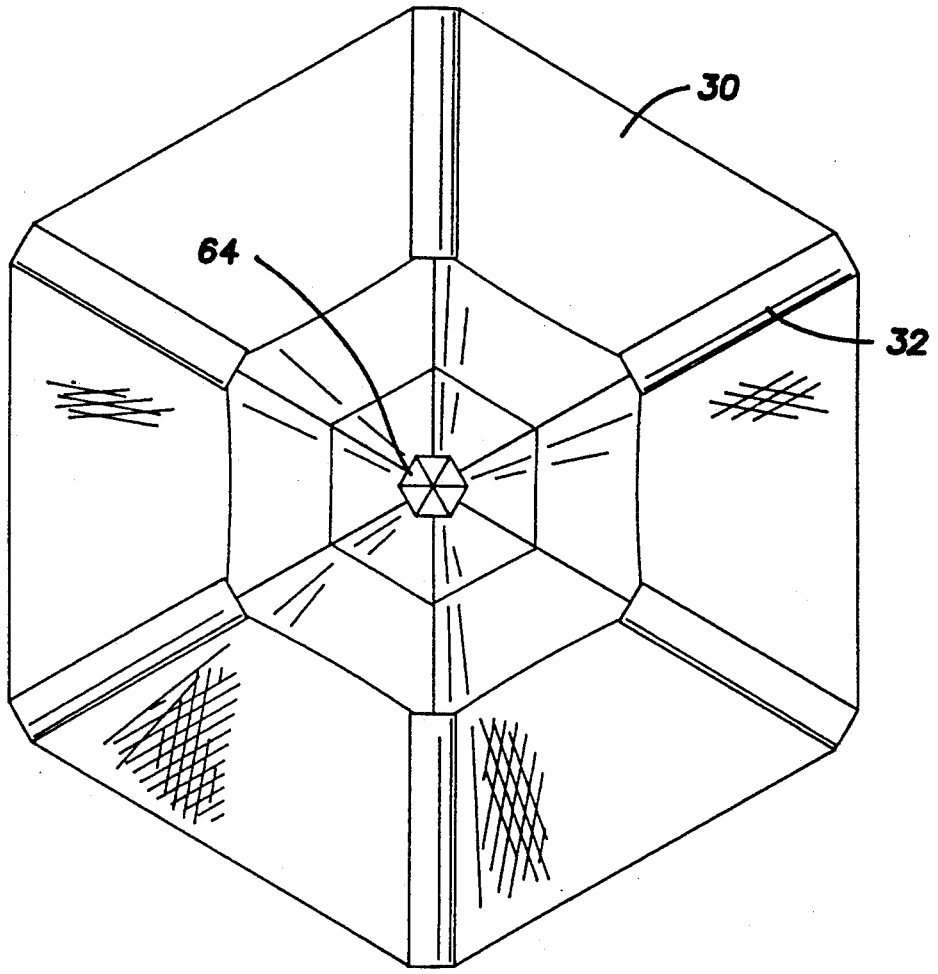
FIG. 3 is a top plan view of the umbrella shown in FIG. 1.

Shown in FIG. 1 is a preferred embodiment of an umbrella in accordance with the invention. The umbrella 10 has a shaft 12 having an upper end on which a hub 14 is fixedly secured. A slider 16 is slidably received on the shaft and can travel from a position near the bottom of the shaft to a position wherein the slider abuts the bottom 17 of the hub 14. A releasable latch 18 near the top of the shaft is provided to secure the umbrella in its fully deployed configuration.

In accordance with the illustrated embodiment, six articulated canopy support arms 20 (see FIG. 4) are attached to the shaft to form the canopy support structure or frame of the umbrella. Each arm is a unitary integrated component having three rib segments and a support strut. Each arm is made from a substantially rectangular strip of plastic by cutting two slits 86 and 88 into the plastic strip and forming six narrow regions of reduced thickness to create living hinges 34, 36, 38, 40, 42 and 44. An outer rib 26 is defined by the edges of the plastic strip, living hinge 42, living hinge 40, and a segment of slit 88 which extends from point A to point E in FIG. 4.

Figure 4:
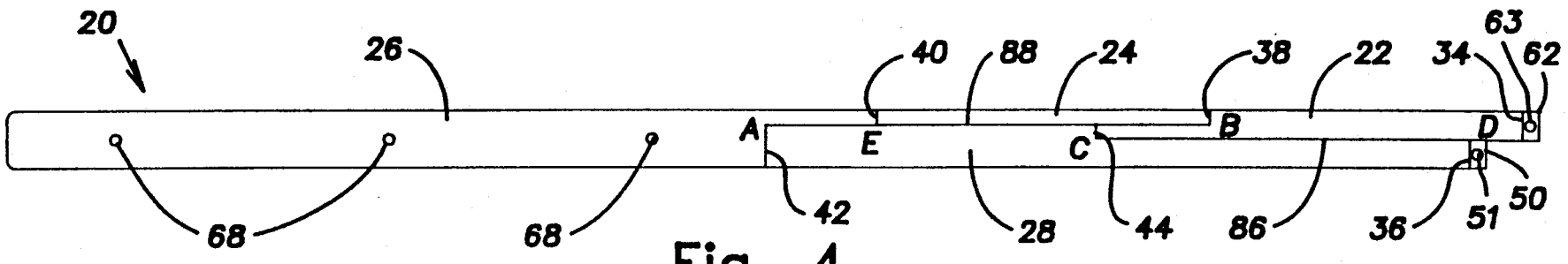
FIG. 4 is a plan view of an articulated canopy support arm, six of which are shown in FIG. 1.

An intermediate rib 24 is defined by an edge of the plastic strip, living hinges 38 and 40, and by the segment of slit 88 extending from point E to point B in FIG. 4. An inner rib 22 is defined by an edge of the plastic strip, living hinges 34, 38 and 44, and by slit 86 which extends from point C to point D in FIG. 4. A strut 28 is defined by an edge of the plastic strip, living hinges 36, 42 and 44, by a segment of slit 88 extending from point A to point C, and by slit 86. The living hinges provide flexibility and allow the rib segments and the strut to be rotated relative to an adjacent rib or strut.

A small tab 50 connected by a living hinge 36 to the inner end of the strut 28 and having a hole 51 is provided for fastening the arm 20 to the slider 16. Another similar tab 62 connected by a living hinge 34 to the inner end of the inner rib and having a hole 63 is provided for fastening each arm 20 to the hub 14.

Figure 7:
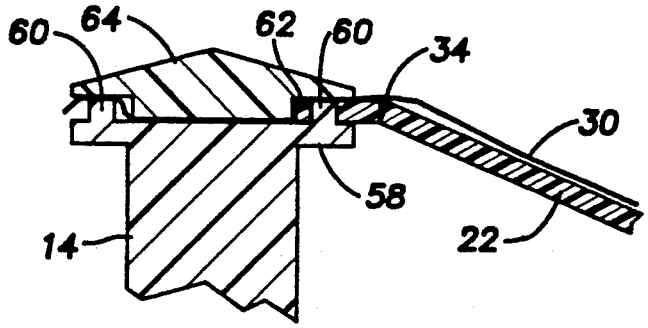
FIG. 7 is a fragmentary elevational cross section of the hub showing details of how the support arms are secured to the hub.

The method by which the tabs 62 of the support arms 20 are fastened to the hub are shown in detail in FIG. 7. At the top of the hub is a flange or plate 58 having six cylindrical pins 60 protruding upwardly from the plate. The pins are uniformly distributed around the periphery of the plate. The holes 63 in tabs 62 are sized to snugly fit onto the pins 60. The canopy 30 is then centered on the hub. The canopy is provided with six holes which also fit over the pins 60. The canopy and support arms are secured to the hub by cementing cap 64 to the top of the pins 60.

Figure 8:
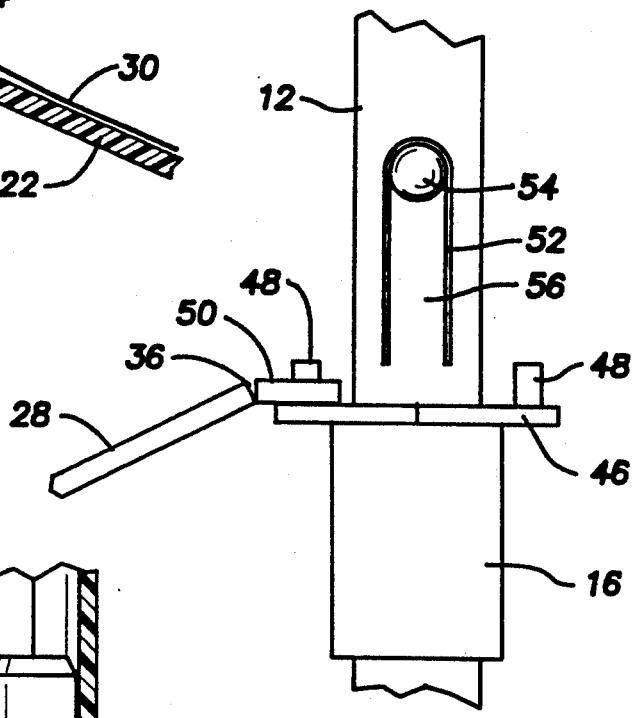
FIG. 8 is a fragmentary elevational view of the upper portion of the shaft, showing details of the latch and how the struts are secured to the slider.
Figure 9:
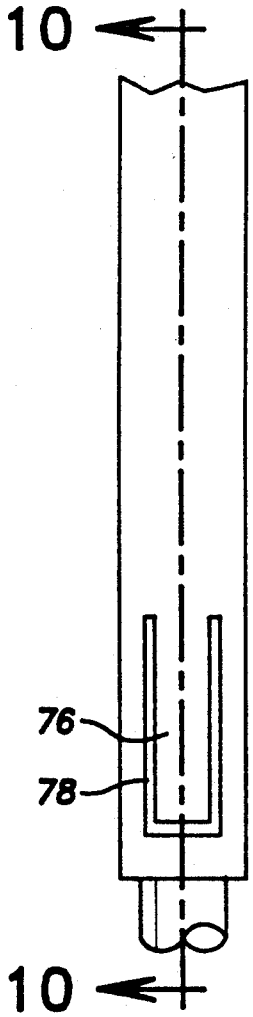
FIG. 9 is a fragmentary elevational view of the lower portion of the shaft, showing external details of the catch for the extension rod.

The tabs 50 are secured to the slider in a similar manner as shown in FIG. 8. The top of the slider 16 has a flange or plate 46 from which pins 48 upwardly protrude. Six pins are distributed uniformly around the periphery of the plate 46 and holes 51 are provided to snugly receive the pins 48. The tabs 50 are cemented or otherwise fastened to the pins 48 and the top of the plate 46 to ensure that arms 20 are securely fixed to the plate 46.

Figure 6:
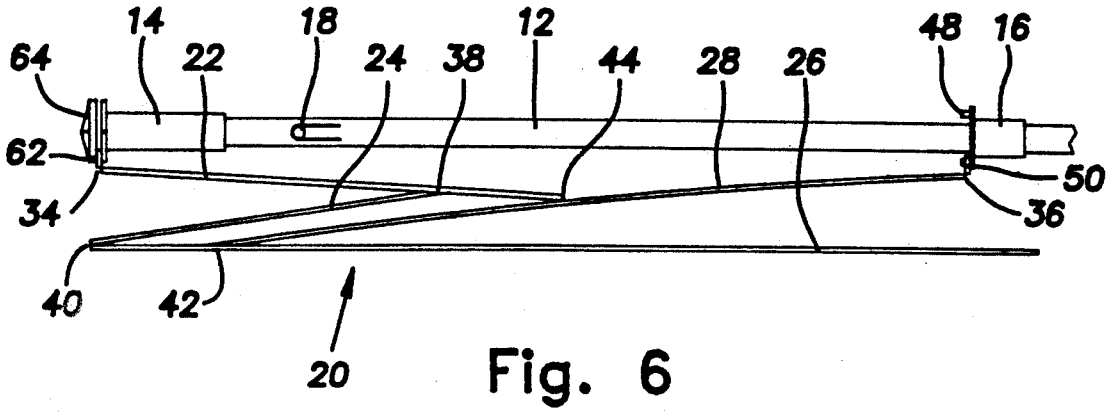
FIG. 6 is a fragmentary side elevational view showing the frame of the umbrella shown in FIG. 1 when the umbrella is only slightly open.

FIG. 6 shows a single support arm 20 affixed to hub 14 via tab 62 and affixed to slider 16 via tab 50. The arm is only slightly deployed to show how the various rib segments and the strut overlap one another when the umbrella is folded to its nested configuration.

Figure 5:
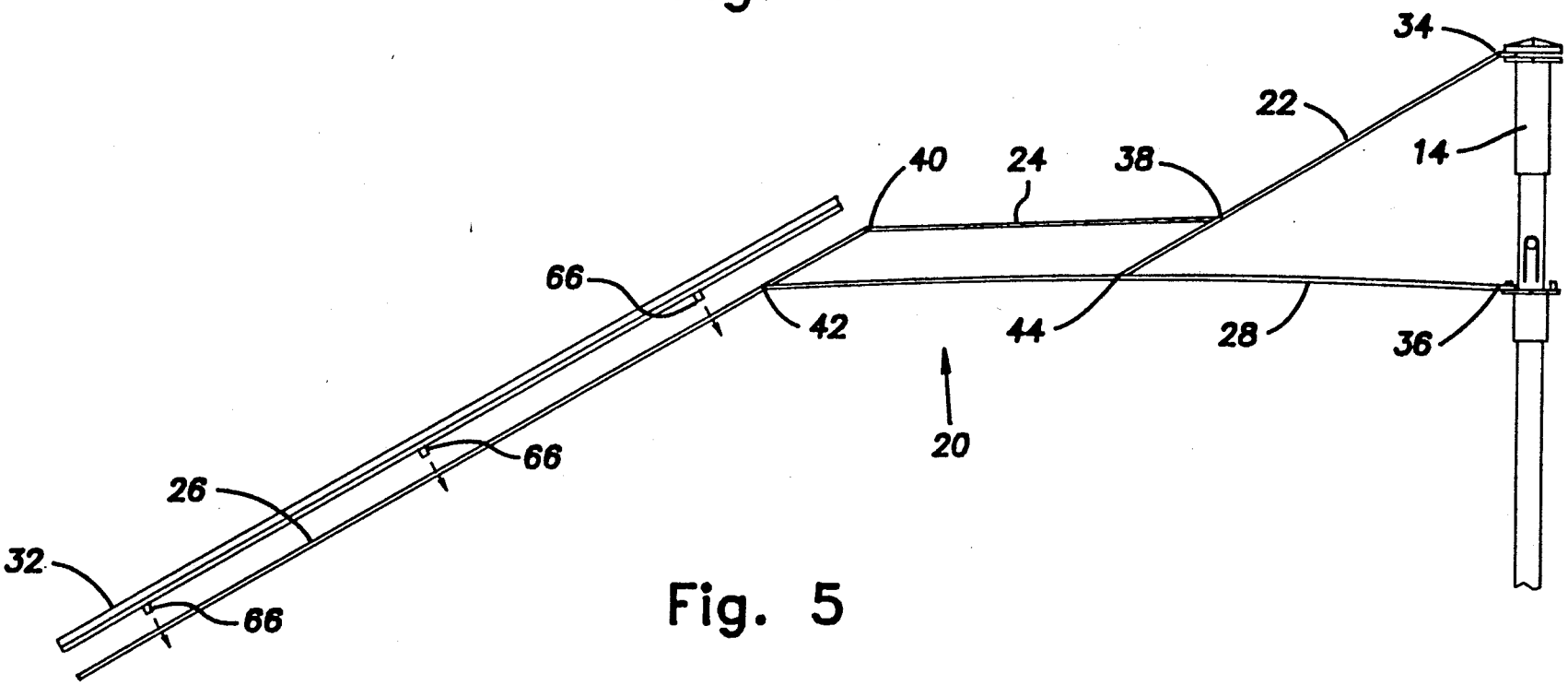
FIG. 5 is a fragmentary side elevational view showing the frame of the umbrella shown in FIG. 1 when the umbrella is deployed.

A single support arm 20 in its fully deployed configuration is shown in FIG. 5. A rib cover 32 is show in FIG. 5, attached to the outer rib with the canopy omitted. Each rib cover 32 is formed from a substantially rectangular strip of plastic which is bent or curved along its width to constitute one-sixth of a cylindrical wall as shown in FIG. 2. Alternately, the shape of the rib cover 32 along its width may be flat or other shapes. It is desirable, however, that the effective width of the ribs should be such that the ribs contact each other along their edges when the umbrella is in a folded condition. The rib cover has three nibs 66 distributed along its center longitudinal direction. Three holes 68 are provided in each outer rib 26 to snugly receive the nibs 66. In addition to being affixed to the umbrella at its center by the cap 64, the canopy 30 is sandwiched between the outer ribs and the rib cover, and is preferably cemented to the support arms at various points along the upper and intermediate ribs. The canopy is provided with eighteen holes, six radially aligned rows having three holes each, each of which lines up with a corresponding hole on an outer rib. The nibs 68 on the rib cover 32 fit through the holes in the canopy 30 and are cemented into the holes 68 of the outer ribs 26. Other fastening means will be known by those skilled in the art.

Additionally, the rib covers may optionally be provided with slots 90, holes, notches or the like, to permit water to drain from and/or permit dry air to enter and moist air to exit from the space between the canopy and rib covers when the umbrella is folded into its nested configuration.

A latch 18 is provided near tee top of shaft 12 to releasibly retain the slider in abutment with the bottom 17 of hub 14. The latch 18 is shown in detail in FIG. 8. In accordance with the preferred embodiment of the invention, a small hemispherical protrusion or detent 54 is provided near the top of shaft 12. An inverted U-shaped slot 52 is cut into hollow shaft 12 to form a latch spring 56. To deploy the canopy, the slider is slid up along the shaft and over the detent which is automatically depressed inward by the force exerted through the slider. The detent then snugly urges the slider against the bottom of the hub while the canopy is deployed. To return the canopy to its nested configuration, force is applied to the latch spring to force the detent inward while the slider is pulled down over the detent. The latch spring is then released and the slider is moved to its lowest position on the shaft.

Figure 10:
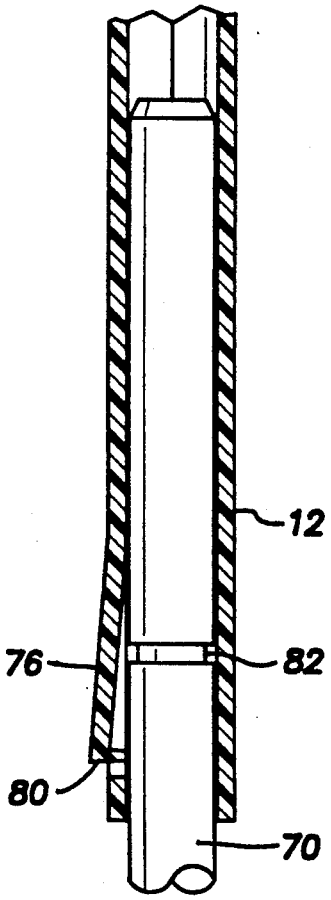
FIG. 10 is a fragmentary elevational cross section taken along view lines X—X in FIG. 9 which shows internal details of the catch for the extension rod.
Figure 11:
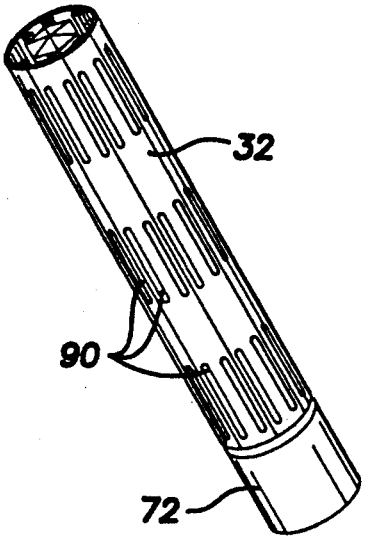
FIG. 11 is a perspective view of an umbrella in accordance with the invention having slots in the rib cover.

Because the canopy support structure folds into a compact configuration with rib sections overlapping in the nested condition, the umbrella is preferably provided with a telescoping rod 70 which is slidably received in the hollow shaft 12. The telescoping rod 70 permits the umbrella to have a standard sized umbrella stem or shaft, making it easy to use the umbrella, Yet enables the umbrella to be collapsed into a compact, solid, nested configuration when it is not in use. The rod is provided with an upper groove 82 and a lower groove 84, each of which is capable of cooperating with a catch 80, shown in FIG. 10, to firmly hold the rod in either its deployed or nested position. The catch 80 is a small, inwardly directed protrusion on the bottom edge of a catch spring formed near the bottom of shaft 12 by cutting a U-shaped slot into the shaft. The catch fits snugly into lower groove 84 when the rod is fully pushed into the shaft but is easily dislodged by grasping the umbrella in one hand and pulling on handle 72 with the other hand. Similarly, the catch fits snugly into the upper groove 82 when the rod is fully deployed to maintain the rod in its extended position but is easily dislodged by pushing handle 72 toward the top of the umbrella. The handle 72 preferably has a cylindrical shape with a diameter equal to that of the cylinder formed by rib covers 32 when the umbrella is folded into its nested configuration, thus producing a perfect cylindrical shape, as shown in FIG. 2, when the rod and umbrella support are collapsed for storage.

The umbrella is preferably made entirely from plastic materials, such as polyolefins, with a copolymer of polyethylene and polypropylene being most preferred. The canopy can be made from a plastic sheet which is positioned on a punch die to assure proper alignment and to punch twenty-four holes into the sheet. The shaft is preferably made from two injection mold halves which are ultrasonically welded together. The support arms are preferably made by cutting extruded plastic sheets into strips having the shape outlined in FIG. 4, cutting slits 86 and 88, partially cutting through the strip or routing to form the living hinges and punching the nib holes and pin holes. The cap, hub and slider are preferably injection molded. The rod, handle and rib covers can be manufactured from extruded materials.

Although the preferred embodiment of this invention has been shown and described, it should be understood that various modifications and rearrangements of the parts may be resorted to without departing from the scope of the invention as disclosed and claimed herein.

What is claimed is:

1. A compact, collapsible umbrella comprising:

a shaft having an upper and lower end;

a hub fixedly secured to the upper end of said shaft;

a slider, said slider being slidably received on said shaft and being operable to move the umbrella between a deployed configuration and a nested configuration;

means for releasibly retaining the umbrella in the deployed configuration;

a plurality of plastic canopy support arms extending radially from said shaft;

a canopy operatively secured to the canopy support arms, each of said support arms being operatively connected to the hub and slider; and, a plurality of rib covers, each of said rib covers at least partially overlying one of said support arms, said canopy being at least partially positioned and retained between said rib covers and said support arms.

2. A compact, collapsible umbrella as recited in claim 1, wherein said shaft is hollow and slidably receives a telescoping rod.

3. A compact, collapsible umbrella as recited in claim 1, wherein said support arms are connected to the hub and the slider by living hinge means.

4. A compact, collapsible umbrella as recited in claim 1, wherein each articulated canopy support arm has an inner rib, an intermediate rib, an outer rib, and a strut, an inner end of each inner rib being hingedly connected to the hub and an outer end of each inner rib being connected through a living hinge to an intermediate point on the strut, an inner end of each strut being hingedly connected to the slider and an outer end of each strut being connected through a living hinge to an intermediate point on the outer rib, an inner end of each intermediate rib being connected through a living hinge to an intermediate point on the inner rib and an outer end of each intermediate rib being connected through a living hinge to an inner end of the outer rib.

5. A compact, collapsible umbrella comprising:

a shaft having an upper and a lower end;

a hub fixedly secured to the upper end of said shaft;

a slider, said slider being slidably received on said shaft and being operable to move the umbrella between a deployed configuration and a nested configuration;

means for releasibly retaining the umbrella in the deployed configuration;

a plurality of plastic canopy support arms extending radially from said shaft, said arms being operatively hingedly connected to said hub and to said slider;

a canopy operatively secured to the canopy support arms; and a plurality of rib covers, each of said rib covers being affixed to one of the canopy support arms, a portion of said canopy being trapped therebetween, wherein the rib covers form a substantially continuous surface when the umbrella is in the nested configuration.

6. A compact, collapsible umbrella as recited in claim 5, wherein said shaft is hollow and slidably receives a telescoping rod.

7. A compact, collapsible umbrella as recited in claim 5, wherein said support arms are connected to the hub and the slider by living hinge means.

8. A compact, collapsible umbrella as recited in claim 5, wherein each of said rib covers is shaped so that lengthwise edges of adjacent rib covers abut to form a substantially continuous rigid cylinder when the umbrella is in the nested configuration.

9. A compact, collapsible umbrella as recited in claim 5, wherein said rib covers have slots.

10. A compact, collapsible umbrella comprising:

a shaft having an upper end, a lower end, and a longitudinal axis;

a hub fixedly secured to the upper end of said shaft;

a slider, said slider being slidably received on said shaft and being operable to move the umbrella between a deployed configuration and a nested configuration.

means for releasibly retaining the umbrella in the deployed configuration;

a plurality of articulated canopy support arms extending radially from the axis of said shaft, each arm having rib means and an elongated strut, wherein said rib means comprises a plurality of ribs, said plurality of ribs being interconnected by living hinges, a first end of the strut being hingedly connected to said slider and a second, opposite end being connected to one of the ribs by an integral living hinge, an end of one of the ribs being hingedly connected to said hub, the ribs of each arm at least partially overlapping when the umbrella is in the nested configuration;

a canopy secured to the articulated canopy support arms; and an elongated, rigid rib cover, said rib cover being affixed to one of the ribs of each canopy support arm and having a portion of said canopy sandwiched therebetween, wherein the rib covers form a substantially continuous solid surface, with the shaft, canopy and support arms contained therein when the umbrella is in the nested configuration.

11. A compact, collapsible umbrella as recited in claim 10, wherein said shaft is hollow and slidably receives a telescoping rod.

12. A compact, collapsible umbrella as recited in claim 10, wherein the hinged connections between the ribs and the hub, and between the struts and the slider are living hinges.

13. A compact, collapsible umbrella as recited in claim 10, wherein said rib means comprises an inner rib, an intermediate rib, an outer rib, and a strut, an inner end of each inner rib being hingedly connected to the hub and an outer end of each inner rib being connected through a living hinge to an intermediate point on the strut, an inner end of each strut being hingedly connected to the slider and an outer end of each strut being connected through a living hinge to an intermediate point on the outer rib, an inner end of each intermediate rib being connected through a living hinge to an intermediate point on the inner rib and an outer end of each intermediate rib being connected through a living hinge to an inner end of the outer rib.

14. A compact, collapsible umbrella as recited in claim 10, wherein each of said rib covers is rectangular and curved along its width so that lengthwise edges of adjacent rib covers abut to form a generally continuous rigid cylinder when the umbrella is in the nested configuration.

15. A compact, collapsible umbrella as recited in claim 10, wherein said rib covers have slots.

16. A compact, collapsible umbrella as recited in claim 2, wherein each of said canopy support arms comprise a multi-segment rib, each of said multi-segment ribs at least partially overlapping when the umbrella is in the nested configuration.

17. A compact, collapsible umbrella as recited in claim 16, wherein said support arms are connected to the hub and the slider by living hinge means.

18. A compact, collapsible umbrella as recited in claim 17, wherein each articulated canopy support arm has an inner rib, an intermediate rib, an outer rib, and a strut, an inner end of each inner rib being hingedly connected to the hub and an outer end of each inner rib being connected through a living hinge to an intermediate point on the strut, an inner end of each strut being hingedly connected to the slider and an outer end of each strut being connected through a living hinge to an intermediate point on the outer rib, an inner end of each intermediate rib being connected through a living hinge to an intermediate point on the inner rib and an outer end of each intermediate rib being connected through a living hinge to an inner end of the outer rib.

* * * * *

UNITED STATES PATENT AND TRADEMARK OFFICE

CERTIFICATE OF CORRECTION

PATENT NO. : 5,235,997

DATED : August 17, 1993

INVENTOR(S) : Sidney R. Good

It is certified that error appears in the above-identified patent and that said Letters Patent is hereby corrected as shown below:

Column 2, line 42, "polypropylene/olyethylene" should be --polypropylene/polyethylene--.

Column 4, line 49, "tee" should be --the--.

Column 5, line 4, "Yet" should be --yet--.

Signed and Sealed this

Nineteenth Day of April, 1994

*Attest:*

*Attesting Officer*

BRUCE LEHMAN

*Commissioner of Patents and Trademarks*